US006318724B1

(12) United States Patent
Carames

(10) Patent No.: US 6,318,724 B1
(45) Date of Patent: Nov. 20, 2001

(54) ELECTRONIC AMUSEMENT DEVICE

(76) Inventor: Jose Antonio Carames, Pintor Sorolla No. 3, E-08210 Barbera del Valles (ES)

( * ) Notice: Subject to any disclaimer, the term of this patent is extended or adjusted under 35 U.S.C. 154(b) by 0 days.

(21) Appl. No.: 09/233,528

(22) Filed: Jan. 20, 1999

(51) Int. Cl.[7] ..... A63F 07/20
(52) U.S. Cl. ..... 273/317.4; 273/317
(58) Field of Search ..... 273/317.4, 317.1, 273/108.4, 108.41, 317.2, 317.3

(56) References Cited

U.S. PATENT DOCUMENTS 5,344,142 * 9/1994 Barreira ..... 273/85

FOREIGN PATENT DOCUMENTS

WO 98/09695 3/1998 (WO) .

* cited by examiner

*Primary Examiner*—Jeanette E. Chapman
*Assistant Examiner*—M. Chambers
(74) *Attorney, Agent, or Firm*—Peter F. Corless; Lisa Swiszcz Hazzard; Edwards & Angell, LLP

(57) ABSTRACT

Machine for competition and entertainment through impulse of an object with three-dimensional freedom of movement where two teams of participants play a game, one team on either side shooting an object with three-dimensional freedom of movement (1.3) to one another. The object moves on a gameboard (1.1) until one team fails to repel it, thus scoring points for one of the participants. Repulsion of the object originates from a repulsion sector (1.9) from which, by working a group of controls (1.7 and 1.8), movement can be provoked. The mobile object (1.3) has freedom within a zone where it is controlled by a mechanical system (1.6) where the movements are produced as a result of the action of motive elements which are governed by a control unit according to the position of the mobile object, the position of the repulsion sector and the operation of the controls.

2 Claims, 3 Drawing Sheets

ELECTRONIC AMUSEMENT DEVICE

Figure 1:
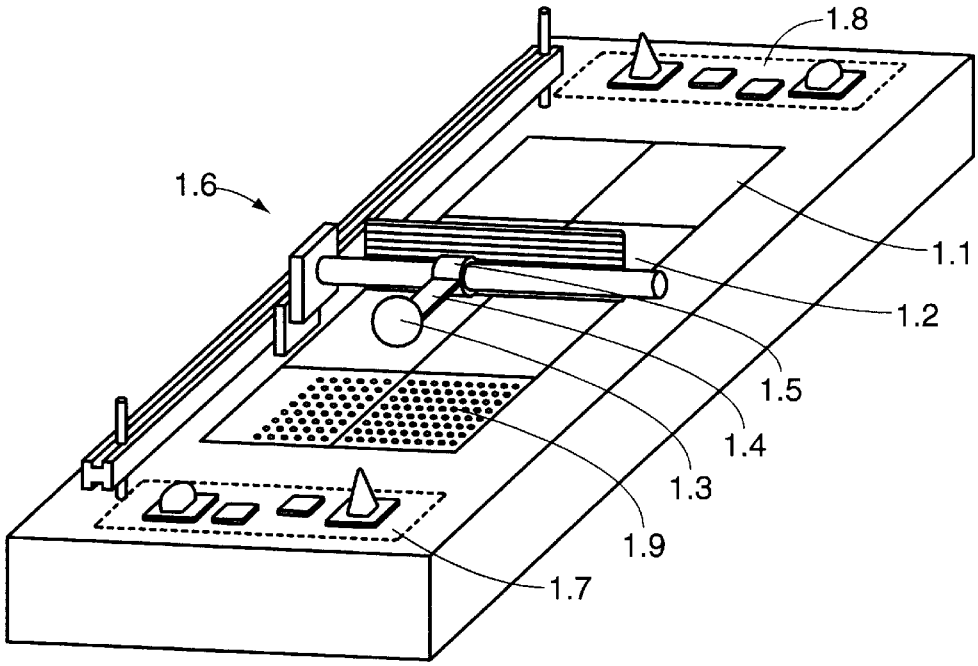

The object of the invention is a competition and entertainment game functioning through activation of an object with three-dimensional freedom of movement. More particularly, the present invention is particularly suitable for sporting competitions between two teams, formed of one or more players depending on the game mode. The teams are situated on opposite sides of the gameboard. The teams shoot a mobile object, preferably spherical in shape, back and forth over the gameboard. The mobile object has three-dimensional freedom of movement and can be moved three-dimensionally over the gameboad until one of the teams fails to repel it, much like the motion of, for example, a tennis ball during a tennis match. The teams then compete by scoring points depending on the rules established for the game mode in use. In this way, for example, points may be scored in a manner consistent with popular sports like tennis, table tennis and volleyball. This may either be, for example, when the mobile game clement touches the gameboard outside the zones permitted by the selected game mode, when the mobile element lands within the permitted zones and the team fails to repel it back to the opposing team, or if the opposing team fails to hit the mobile object before it hits the surface of the gameboard.

Through activation of controls, each team can control the position of a repulsion sector which performs the function of a racquet as well as controlling the direction, effect and strength of the repulsion applied to the mobile game object, thereby allowing a team to control the direction and force with which the object is repelled out of the repulsion sector.

The action of repelling the ball or mobile object is performed by specific electromechanical means that are triggered by controls in a control center. The control center preferably comprises a number of conventional controls such as, for example, buttons that are operable by the user of the device. As the controls are activated by the user, depending on how the aforementioned controls are operated and programmed, the positions of the mobile object and the repulsion sector that performs the function of a racquet are controlled. The user manipulates the controls in the control center, which then trigger the electromechanical elements to operate as programmed to produce controlled impulses directed at the mobile object and, thereby, control the three-dimensional movement of the mobile object.

The electromechanic means detects the position of the mobile object and the manipulation of controls which determine the effect with which the action of repulsion is to be carried out, by using reading means which reads particular data available to the control center and data supplied by other elements with the capacity to detect position. These elements are located in the machine's mechanical system and in the control unit, which governs and manipulates the repulsion zones.

More specifically, the invention concentrates on controlling the position and movement of the element with freedom of three-dimensional movement; selective activation of repulsion zones; controlling the position and the intention of impulse production from each repulsion zone or racquet; the physical system used to perform the aforementioned operations; and the actual constitution of the machine used for the competition, with the arrangement of the elements of which it is composed.

BACKGROUND OF THE INVENTION

Sports competition and entertainment machines are known. Such existing sports competition and entertainment machines are usually limited to a few types. For example, some machines consist of a soccer-like or hockey-like gameboard where the two sides compete for an object which can be moved around the field of play by elements situated across the gameboard, wherein the elements are governed by the players through controls. The aim of such games is getting the object into an opposing goal.

Another type of existing machine is designed so that the players shoot a chip or ball to each other from one side of the gameboard to the other, until one of the players scores a point by introducing the chip or ball into the opposing goal.

In theses machines, however, the movement of the ball or chip is two-dimensional. For example, the machine described in PCT/ES94/00024, incorporated herein by reference, is one example of such a machine.

In some types of the aforementioned machines, the gameball is usually able to move completely freely when it, for example, is in a pocket or propelling means and is expelled towards a basket or a goal. However, in these machines, the gameball's three-dimensional freedom of movement is not permanently controllable in terms of movement and position. Thus, for three-dimensional games like tennis, which to be played properly within the limited space of a machine, require total control over the position and movements of the ball, such machines are not suitable.

At present there are no machines for sports competitions like tennis, table-tennis and volleyball, where the ball or object in play has three-dimensional freedom of movement; where the ball or object is mounted on a mechanical apparatus; where a set of controls may be manipulated by a user to signal the mechanical apparatus as to the desired direction and force for moving the ball or object; where the mechanical apparatus receives the signals from the set of controls and responds to the signals by moving the ball or object in accordance with the signals; and the motion of the ball or object is controlled at all times by the mechanical apparatus such that the ball or object is prevented from leaving the gameboard and going out of the players' control.

In contrast to models currently on the market, the machine described herein permits competition through the activation of a mobile object or gameball, where this gameball or mobile element can be moved freely three-dimensionally within a limited volume of game zone; where both the position of this gameball within the limits of the volume of space of free movement determined by the machine's systems, its position in relation to the zones of the filed of play which the player wishes to control and the authorized repulsion sectors which perform the function of racquets, depending on the kind of game, are all controlled at all times.

Construction of the invention described herein produces an automatically-controlled machine. This machine is made all the more attractive by the wide variety of possible operations in a game, the fact that it is possible to play games like tennis and volleyball and the fact that using the machine requires physical exercise, training and use of the reflexes.

For the above reasons, learning to master and enjoy the game will appeal to a very wide sector of the public. Basically, the machine is a new product concept with better commercial prospects than existing machines along the same lines. The new design of the machine allowing new kinds of competition, the easily-understood operation of the games and the accessible production costs result in a product of great commercial potential on both domestic and international markets.

The result of the above is a world novelty with many market options due to the scarcity of novelty products in the sports competition market. Therefore, the creation of manufacturing structures and the generation of these new products is viable. In commercial terms it is necessary to produce a new generation of sports competition and entertainment games using an object with three-dimensional movement. The range of game options presently available in the machines currently on the market can be widened by incorporating new inventions with game possibilities that make machines simpler and more reliable, comfortable, entertaining, educational, and, above all, safe.

DESCRIPTION OF THE INVENTION

The invention centers on a new configuration of machines for competition and entertainment through activation of a mobile object. The object moves with three-dimensional freedom of movement. Its relative position within a sector of space over a gameboard is controlled at all times. The object moves across the gameboard depending on its own position, the position of an authorized repulsion sector and also on the handling of the sets of game controls belonging to each side.

The aforementioned three-dimensional sector is located over a gameboard in such a way as to allow different types of competition, in particular: tennis, volleyball, table-tennis and other similar games. The games are played by producing the three-dimensional movement of the gameball over the aforementioned gameboard. The gameboard may be equipped with a net to separate the two halves of the gameboard, the height of which will vary according to the game.

According to this invention, each of the control systems is formed of a set of mechanical organs equipped with elements that allow them to be held manually. These elements allow the players on the one hand to modify the position of the activated repulsion sector, commonly referred to as the "bat" or "racquet", and on the other, to shoot the gameball according to the desired speed, direction and effect.

Fundamentally, the ball or game element, which moves three-dimensionally around a sector of space located above the gameboard, is subject to space limitations imposed by a supports system which allows the ball or game element to move three-dimensionally, the support system being a group of mechanisms, or mechanical apparatus,which hold the ball. The way these mechanisms are grouped provides three-dimensional movement of the ball or object as a result of the sum of the contributions of each of the three axes of coordinates of the different types of independent movements of the ball. The desired movement can be obtained by appropriate manipulation of the controls, which provoke the movement of the support system or mechanical apparatus.

The group of mechanisms consists of a combination of linear guides for linear movement and radial guides for radial movement. These permit the gameball to make composite movements which are the results of the two-dimensional movements in relation to the two horizontal coordinates axes parallel to the plane of the gameboard and of vertical movements in the dimension perpendicular to the plane of the gameboard, in this way making any kind of three-dimensional movement possible. The three-dimensional movement is limited by the mechanical and dimensional characteristics of the aforementioned mechanical system or apparatus on which the ball or object is mounted.

Essentially, the above-mentioned mechanical group is formed by the perpendicular arrangement of a mechanical sub-set structured on a main axis, attached by one or both ends to a two-dimensional displacement system and mounted parallel to the plane and transversal to the gameboard. It incorporates the gameball in such a way as to allow it to move linearly in parallel to the axis and turn around it with a fixed radius. This sub-set essentially consists of a linear guide, which may be equipped with systems for producing linear displacement along the guide-rail of an element which acts as a carrier device, or by other means equipped to produce this movement. The carrier device holds the gameball, maintaining a fixed radius with the axis of rotation, in this way allowing the radial turn of the gameball around the axis which determines the linear guide itself.

The two-dimensional displacement system that holds, by one or both ends, the mechanical sub-set formed of the linear guide with accessories and gameball, is a system that allows the aforementioned guide set to move perpendicular to the main axis of rotation determined by the guide itself. These movements are mainly longitudinal and horizontal in relation to the gameboard. The system may have a vertical component of varying importance depending on how the system is manufactured and on the game mode desired. The lateral support of the mechanical system can be manufactured using a combination of linear displacement systems so that, where two supports are used, they move in unison, and the mechanical system supports both ends of an element which moves in two dimensions and the two ends of the linear bar that performs the function of the axis of rotation. In a more simplified version of the above, the lateral support system can be made using a single line of linear displacement on each side, with the line following either a straight path or a radial path with a projected curvature, using a linear displacement guide for this purpose or a supporting arm in line with an axis, situated at the desired distance from the turning circle.

The transversal linear guide is a mechanical group where the gameball is attached by means of an arm to a carrier device that holds the ball and allows the ball to turn, within a radius defined by the dimensions of the support elements, on an axis constituted by the guide itself. The linear guide also guides the ball and produces the linear displacement of the carrying device. The linear guide may contain a threaded endless screw which, on turning, produces the linear displacement of the carrying device and, therefore, of the gameball. For this, the carrying device has a rolling ring, or some similar device, to connect it to the endless screw, that makes it possible for the carrying device to move to the left or right at a certain speed, depending on the speed and direction of the rotation of the endless screw.

The set of mechanisms that controls the movements of the ball, initiated by electromagnetic motive elements and the control group, contain various detector devices. By reading the detector devices, it is possible to detect the relative position of the mobile object or gameball on the gameboard and in the situation of the activated repulsion area, or racquet, in relation to the ball in order to discover whether it is possible to repel the ball and, if not, whether the point is to be awarded in favor of one of the sides according to the game mode in use. The sets of controls on either side of the machine are to be manipulated by the players in order to selectively activate an authorized repulsion zone, or racquet, from among the plurality of repulsion zones in the field of play. In this way the players can situate the authorized repulsion zone so as to receive the gameball and repel the gameball with an effect which will depend on how the controls have been handled. Each group of controls is equipped with handling devices, the purpose of which is to allow the player, through manipulation of these, to control, on the one hand the position of the repulsion zone and on the other hand the behavior of the motive elements that produce the movement of the gameball starting from the repulsion zone. By working these controls the player can select the action of the impulsors independently of the position of the repulsion zone. Depending on whether or not the gameball is inside the field of action, they can be either manipulated manually or automatically by detecting the presence of the gameball in their field of action through sensors.

In order to illustrate what is set out in this document, this descriptive record is accompanied by various pages of drawings which show clarifying parts of the invention in an illustrative, rather than a limitative, way.

FIG. 1 gives a simplified view of the outline of the machine described in this document. It is equipped with a gameboard (1.1) with a separation net (1.2). The mobile object or gameball (1.3) is attached by an arm (1.4) to a carrier device (1.5) which forms part of the mechanical support and control group of which part can be seen (1.6) and the two sets of controls (1.7 and 1.8) from which the position of the activated repulsion zone and the characteristics of the repulsion to be produced are controlled.

Figure 2:
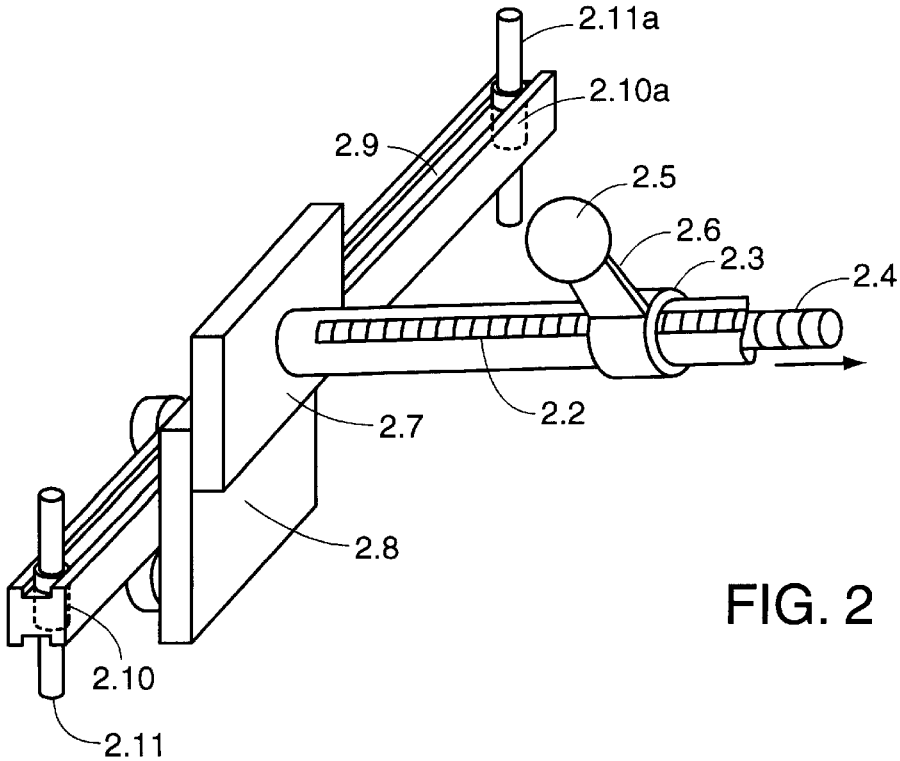

FIG. 2 shows a mechanical system used for the function of supporting and controlling the movement of the gameball, and with which it is possible both to produce and control its movements. The drawing indicates the mechanical elements which constitute the aforementioned group for support and control of the mobile object and we can observe the main axis of rotation, which on the outside is formed of a tube (2.2) with a longitudinal opening. This tube permits the linear displacement of the carrier device (2.3) and when it turns, causes the carrier device to execute an identical turn. We can also observe an endless screw (2.4) inside the tube. On turning, the endless screw causes the linear displacement of the carrier device. FIG. 2 also shows how the mobile object, in this case a ball (2.5), is attached to the carrier device by an arm (.6). We can observe how the main axis of rotation is attached to a support (2.7) which moves in two dimensions orthogonal to the aforementioned axis. This movement is possible as the support is attached to a linear displacement carriage (2.8) mounted on a linear guide (2.9) which in turn can move perpendicularly due to the fact that it is attached by two linear bearings (2.10 and 2.10*a*) to the linear guides (2.11 and 2.11*a*).

Figure 3:
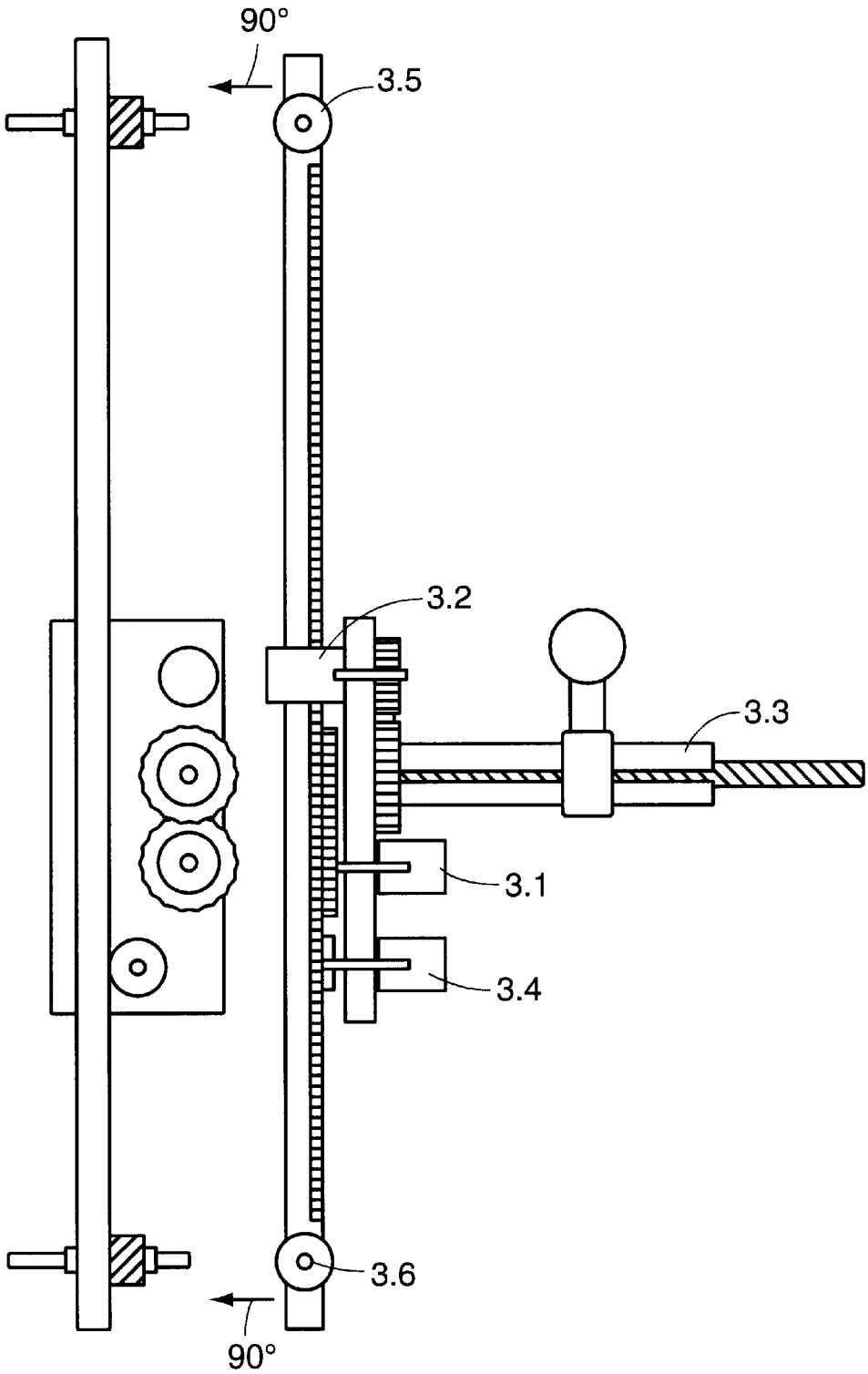

FIG. 3 shows a view of the mechanical support and control group, fitted with different motive elements which produce the movement of the different elements that are activated by the movement of the gameball. We can also observe the motive element (3.1) that produces the rotation of the endless screw which, on turning, produces the linear displacement of the carrier device to which the game element is attached, showing the motive element (3.2) that produces the rotation of the transmitter element (3.3) which transmits the turn to the carrier device. In this drawing the transmitter is a tube with a longitudinal opening which permits linear movement and also transmits the turn to the ball-carrier device and therefore to the ball itself in the form of a radius. We can also observe that on the support base to which the axis of rotation and displacement of the ball is attached, a motive element (3.4) is incorporated that produces the linear displacement of this base. The base, as can be appreciated in the drawing, can be displaced transversely along the linear guides (3.5 and 3.6), moved by the two motive elements (3.7 and 3.8), which in this case are two electrical coils, that regulate its elevation.

Figure 4:
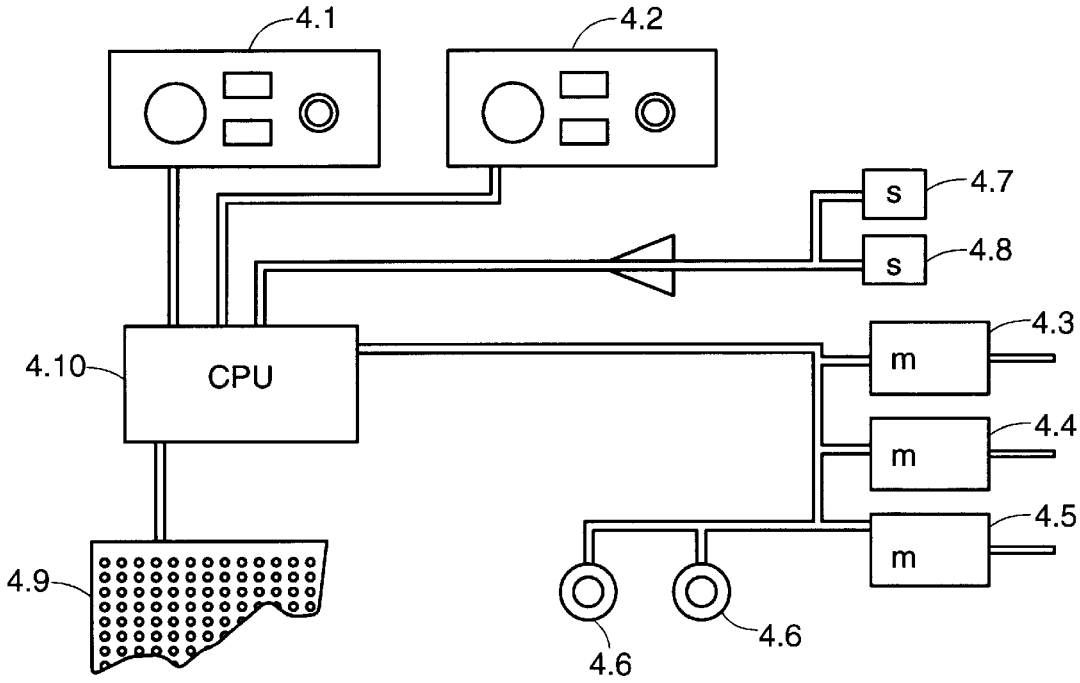

FIG. 4 shown a diagram of the connection of the different elements of the machine to the electronic control system. The diagram shows how the detectors of the control groups (4.1 and 4.2), the motive elements (4.3, 4.4, 4.5, 4.6), the detectors of the mechanical group (4.7 and 4.8) and the position indicators of the authorized repulsion area, of which a part is shown (4.9), are connected to the control center (4.10).

In accordance with the drawings described, it is forseen that the machine for competition, as can be appreciated in FIG. 1, is a machine with a gameboard (1.1), a mobile object for the game which in this case is a ball (1.3), and two sets of controls (1.7 and 1.8). For this machine a gameboard has been created where, depending on the game being played, the gameball can travel in different directions and hit the surface with an effect similar to the bounce produced when a ball hits the ground on a court. Effects similar to those of the behavior of a ball on a tennis court can also be produced, thus permitting tennis or table-tennis matches, or, alternatively, of the behavior of the ball on a volleyball court, making possible the kind of competition where the ball must be prevented from touching the surface without having repelled by the racquet. The function of the racquet is performed by an activated repulsion zone which, as illustrated in FIG. 1, is determined by illuminated by illuminated luminous indicators (1.9) which are illuminated on reception of a command from the control center activating the particular repulsion sector. The position of this sector can be altered by manipulation of the controls using the handling devices.

In this case, the dimensions of the main body of the machine produced are 1600 mm by 1000 mm by 1400 mm, with a flat gameboard of 1200 mm by 900 mm and a net of 160 mm in height. The board has the line markings of a tennis court.

The position of the authorized repulsion zone on either side can be modified in this case by moving in stages around a certain area on each side of the gameboard, which in this case, each side is a rectangle measuring 700 mm by 500 mm. The authorized repulsion sector, which in this case each measures 80 mm by 80 mm, can move around the rectangular area in jumps of 10 mm, which is indicated by the illumination of a series of electroluminescent diodes or LEDS which indicate the edges of the authorized repulsion square. In order to allow this indication, the areas where the authorized repulsion zones can be situated are full of electroluminescent diodes that form a grid of dots 10 mm apart which, when the appropriate LEDS are illuminated, visibly indicate the position of the authorized repulsion zone.

The mechanical group used in this example for controlling and producing the movement of the object is equipped with different motive elements that act to produce the movement of the different elements that control the movement of the ball. These motive elements are servo controlled so that, besides being used to produce the movement of the ball, they are also used to read its position and, as a result, to produce the turn of the endless screw (2.4). Turning the endless screw causes the linear displacement of the carrier device (2.3), to which the game element, in this case a ball (2.5), is attached. A serve controlled motor which can be turned, whose radial position can be detected and with which it is therefore possible to produce the displacement of the carrier device and detect its linear position, is used. To produce the rotation of the ball carrier device (2.3), a rotation transmitter (2.2) is used, which in this case is a tube with a longitudinal opening, which is connected at one end to a servo controlled motor (3.2,) which produces the rotation that the transmitter transmits to the ball-carrier device, in this way controlling the ball-carrier device's radial position and, therefore, the position of the ball itself.

In this case, a servometer is used to produce displacement along the linear guide (2.9), along which the carriage (2.8) moves and to which the base (2.7) supporting the main axis is attached. The servometer is attached to the support itself, and, when used, produces the movement and control of the linear position of the aforementioned support in relation to the guide. The aforementioned support is able to move perpendicular to its own axis, in this case guided by the two linear guides (2.11 and 2.11*a*), using the coils (2.10 and 2.10*a*) and (3.5 and 3.6) as motive elements. By creating a magnetic field of variable strength, depending on the strength of the current with which it is supplied, the servometer produces a strength proportional to the current and moves the guide variably and transversely.

On either side of the gameboard are the two control systems (1.2.1 and 1.2.2). As can be observed in FIG. 3, these are composed in this case of an organ for producing the movement of the activated repulsion zone. In this case, the organ is a trackball, as it is known in the trade, and consists of a ball which can rotate freely in any direction that transmits signals of the movement produced in it. To determine the intention of effect of repulsion, a joystick is used. The aforementioned set of controls is equipped with buttons to permit the "serve" of the mobile object after a point has been scored and the powerful shot, or "smash", as it is known in tennis terminology. These components have not been fully represented in order to simplify the drawings and due to the fact that they are well-known in the trade.

The lines in FIG. 4 indicate the direction of the various signals emitted and received among the different elements such as the control groups (4.1 and 4.2), servometers (4.3, 4.4 and 4.5), coils (4.6), detectors (4.7 and 4.8) and the set of luminous dots (4.9) that display the repulsion sector, towards a conventional control center designed with a microprocessor and peripherals.

In the technique described, modifications within the reach of any expert are possible which, being common knowledge, do not constitute inventive activity or development.

Any modification of the control system worked by the players will not be significant as it will tend to emulate what has been described here.

It is not considered necessary to make this document more extense in order for any expert in the subject to be able to construct the object of the invention by keeping within the essence described in the following pages in the claims.

What is claimed is:

1. A method of using a competition and entertainment device comprising the steps of:

(a) providing an electronic gameboard;

said electronic gameboard having a playing surface;

a mobile object having three-dimensional motion across the gameboard playing surface; the playing surface being divided into opposing sides; each opposing side of the playing surface being divided into a plurality of repulsion sections, wherein at a given time, only one repulsion section on each opposing side may be activated; and each opposing side having at least one set of corresponding controls that control the repulsion sections of the corresponding side, wherein a repulsion section situated in the path of the mobile object may repel the mobile object if the repulsion section is activated by manipulating the controls on the corresponding side; wherein the repulsion zone repels the mobile object by an electronic control system that detects whether the repulsion section is situated in the path of the mobile object and signals the repulsion of the mobile object if the repulsion section is situated in the path of the mobile object and; wherein the set of controls on each opposing side may be manipulated to repel the mobile object with a desired force and in a desired direction, (b) serving the mobile object from one side of the playing surface by manipulating the set of corresponding controls;

(c) manipulating the opposing set of controls to selectively activate a repulsion section on the opposing side of the playing surface;

(d) repelling the mobile object back to the opposing side of the playing surface if the activated repulsion section is in the path of the mobile object; and (e) repeating steps (c) and (d) until one team fails to activate a repulsion section in the path of the mobile object.

2. The method of claim 1 further comprising the step of: manipulating the controls to signal a desired force and direction to repel the mobile object back to the opposing side of the playing surface.

* * * * *